US007909654B2

(12) United States Patent
He et al.

(10) Patent No.: US 7,909,654 B2
(45) Date of Patent: Mar. 22, 2011

(54) PLUG CONNECTOR HAVING AN IMPROVED SHELL

(75) Inventors: Jia-Yong He, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/791,896

(22) Filed: Jun. 2, 2010

(65) Prior Publication Data

US 2010/0304611 A1 Dec. 2, 2010

(51) Int. Cl.
*H01R 24/00* (2006.01)

(52) U.S. Cl. ..... 439/660; 439/76.1; 439/607.22

(58) Field of Classification Search ..... 439/660, 439/76.1, 607.01–607.03, 607.22
See application file for complete search history.

(56) References Cited

U.S. PATENT DOCUMENTS

| | | | | |
|---|---|---|---|---|
| 7,422,488 | B1 | 9/2008 | Wu | |
| 7,762,845 | B1 * | 7/2010 | Huang et al. | 439/607.22 |
| 2009/0098773 | A1 * | 4/2009 | Cheng et al. | 439/607.22 |
| 2009/0117784 | A1 * | 5/2009 | Wu | 439/660 |
| 2010/0003853 | A1 * | 1/2010 | Chuang | 439/607.22 |
| 2010/0216341 | A1 * | 8/2010 | Bryant-Rich | 439/607.22 |

* cited by examiner

*Primary Examiner* — Hien Vu
(74) *Attorney, Agent, or Firm* — Wei Te Chung; Andrew C. Cheng; Ming Chieh Chang

(57) ABSTRACT

A plug connector for mating with a receptacle connector includes a PCB having opposed upper and lower surfaces; a set of metal contacting pads disposed on the upper surface of the PCB; a metal shell enveloping the upper surface of the PCB and collaborating with the upper surface to form a receiving space for receiving a tongue plate of the receptacle connector; and a metal film covering the lower surface of the PCB.

9 Claims, 6 Drawing Sheets

PLUG CONNECTOR HAVING AN IMPROVED SHELL

BACKGROUND OF THE INVENTION

1. Field of the Invention

The present invention relates to a plug connector, and more particularly to a plug connector having an improved shell.

2. Description of Related Art

A conventional plug connector usually comprises an insulative housing defining a base portion and a tongue portion extending forwardly from the base portion, a plurality of contacts retained in the base portion and extending in the tongue portion for mating with a receptacle connector, and a metal shell defining a chamber with the tongue portion extending therein and shielding the tongue portion for preventing electro magnetic interface (EMI).

However, the conventional plug connector has a great volume and is inconvenient for carrying and using for consumers.

Hence, an improved plug connector is desired to overcome the above problems.

BRIEF SUMMARY OF THE INVENTION

According to one aspect of the present invention, a plug connector for mating with a receptacle connector comprises a PCB having opposed upper and lower surfaces; a plurality of metal contacting pads disposed on the upper surface of the PCB; a metal shell enveloping the upper surface of the PCB and collaborating with the upper surface to form a receiving space for receiving a tongue plate of the receptacle connector; and a metal film covering the lower surface of the PCB.

According to another aspect of the present invention, an USB flash disk comprises a PCB defining a base portion and a tongue portion with a plurality of metal contacting pads disposed on an upper surface thereof; a metal shell enveloping the upper surface of the tongue portion and forming a receiving space between the metal shell and the upper surface, the metal shell defining an opening downwardly open to an exterior for a lower surface of the tongue portion to be exposed over; and a metal film covering the lower surface of the PCB.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
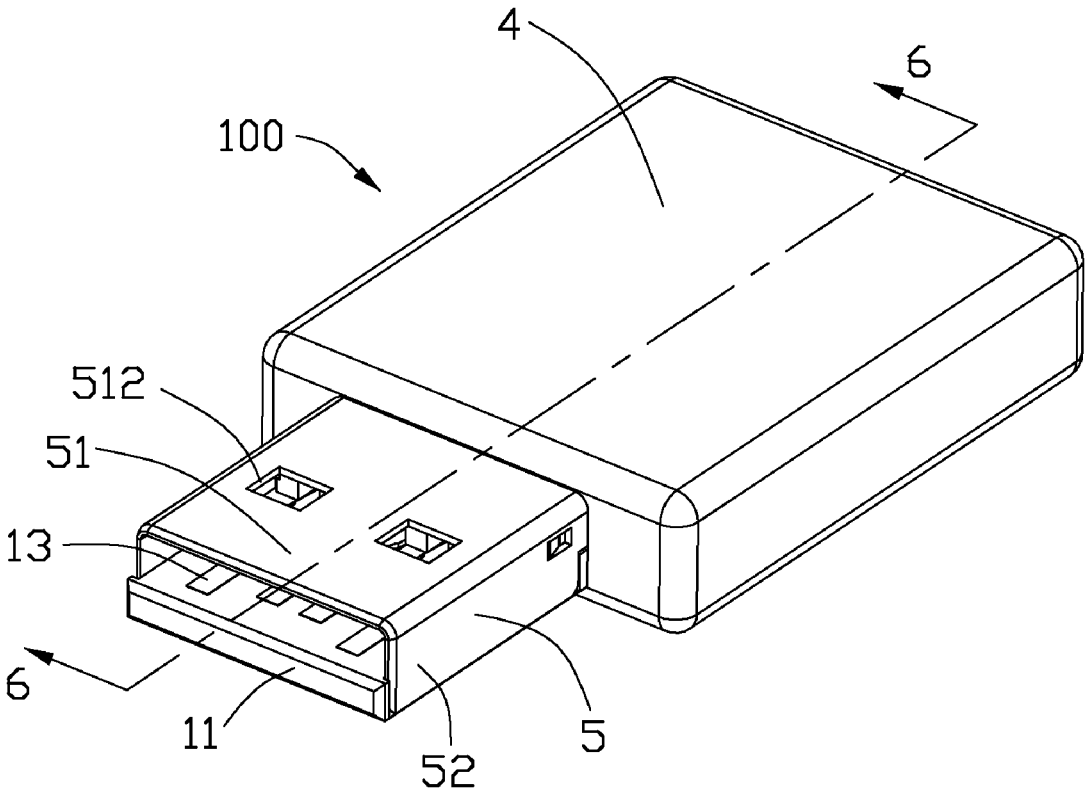
FIG. 1 is an assembled, perspective view of a plug connector of the present invention.
Figure 2:
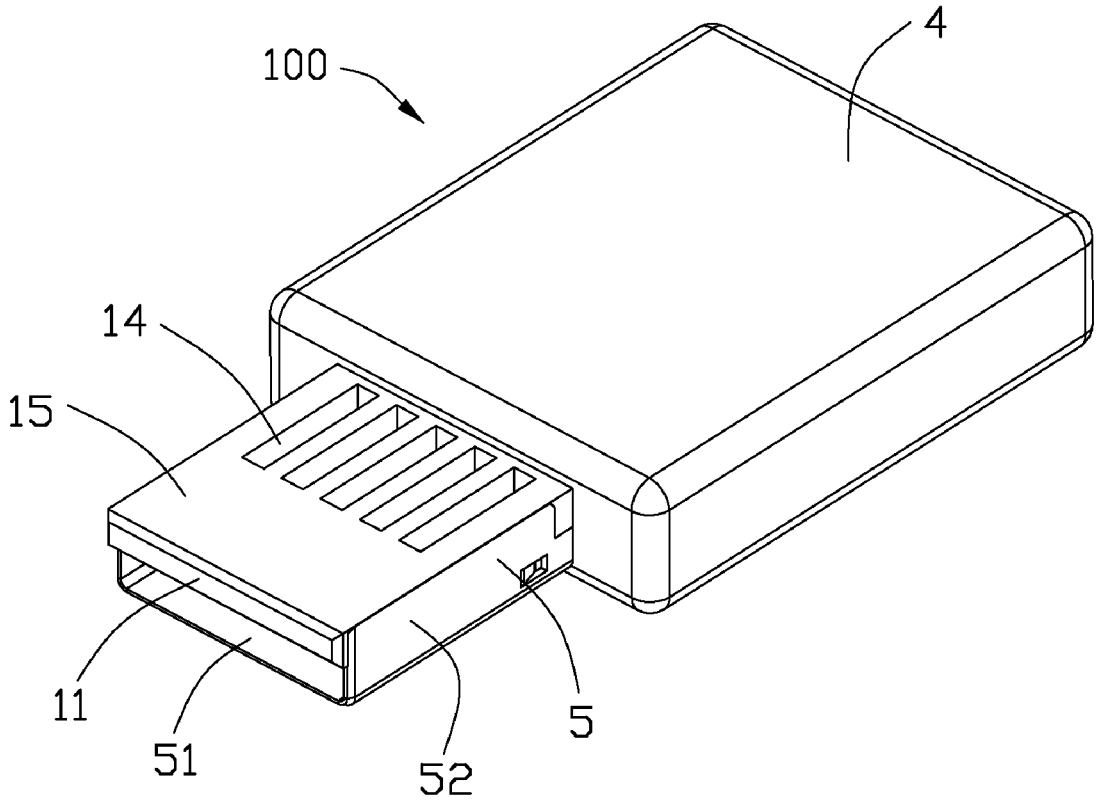
FIG. 2 is similar to FIG. 1, but viewed from another aspect.
Figure 3:
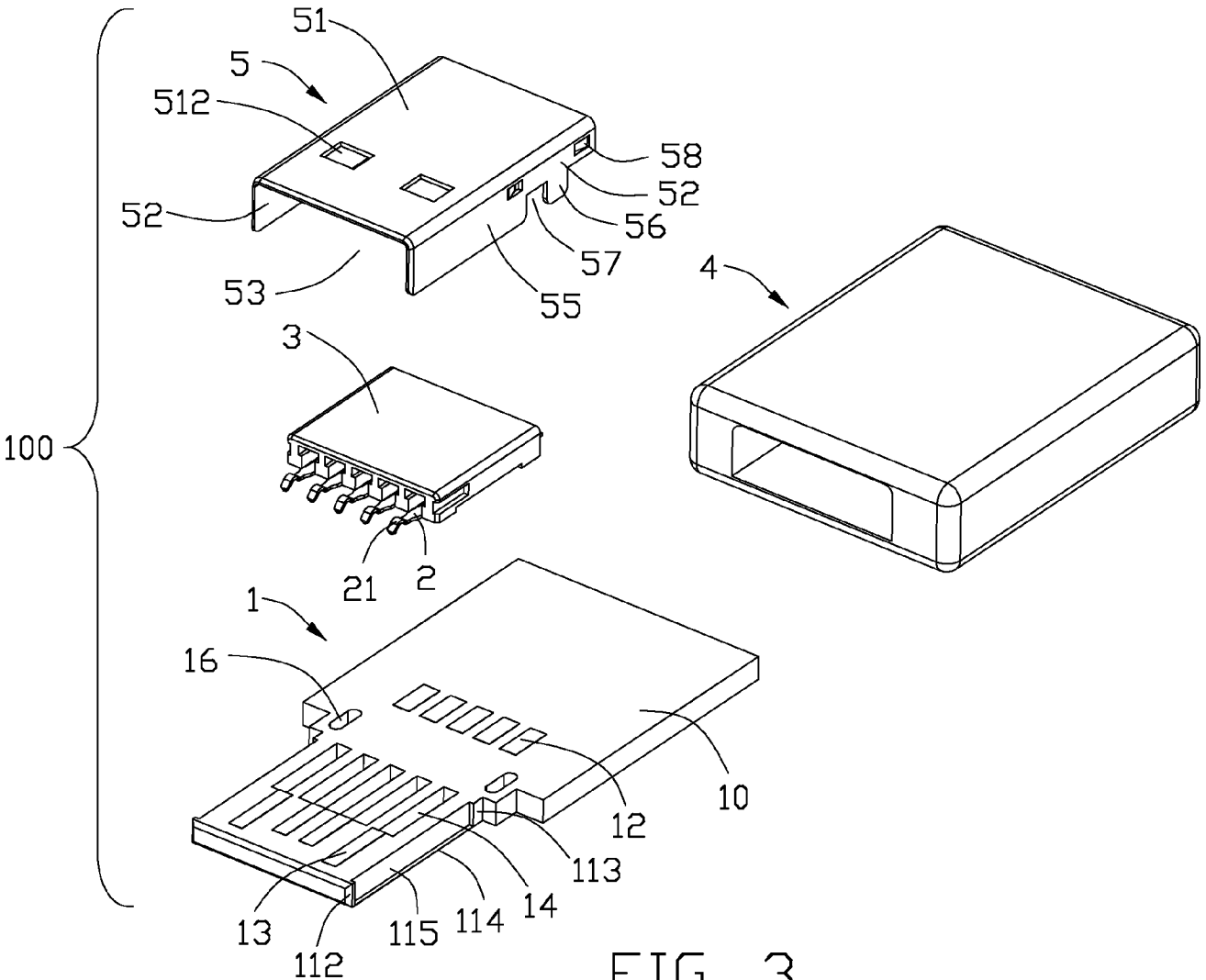
FIG. 3 is a partly exploded perspective view of the plug connector shown in FIG. 1.

Referring to FIGS. 1-3, A plug connector 100 according to the present is adapted for mating with a receptacle connector (not shown) and comprises an printed circuit board (named as PCB hereinafter) 1, a set of resilient contacts 2 coupled to the PCB 1, an insulator 3 attached to the PCB 1, a metal shell 5 covering the PCB 1 and the insulator 3, and a plastic case 4 surrounding the metal shell 5 and the PCB 1.

Figure 4:
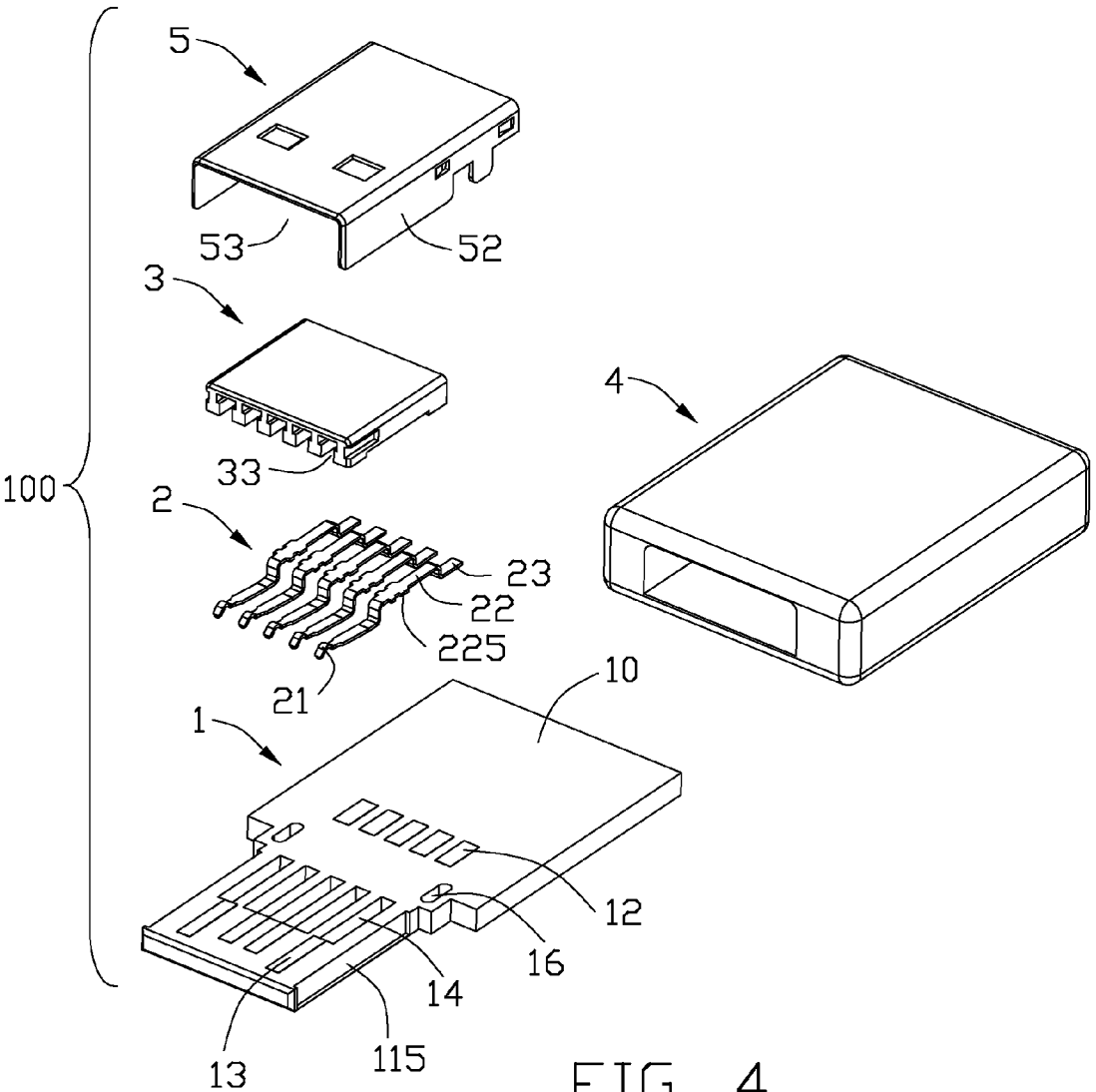
FIG. 4 is an exploded perspective view of the plug connector shown in FIG. 1.
Figure 5:
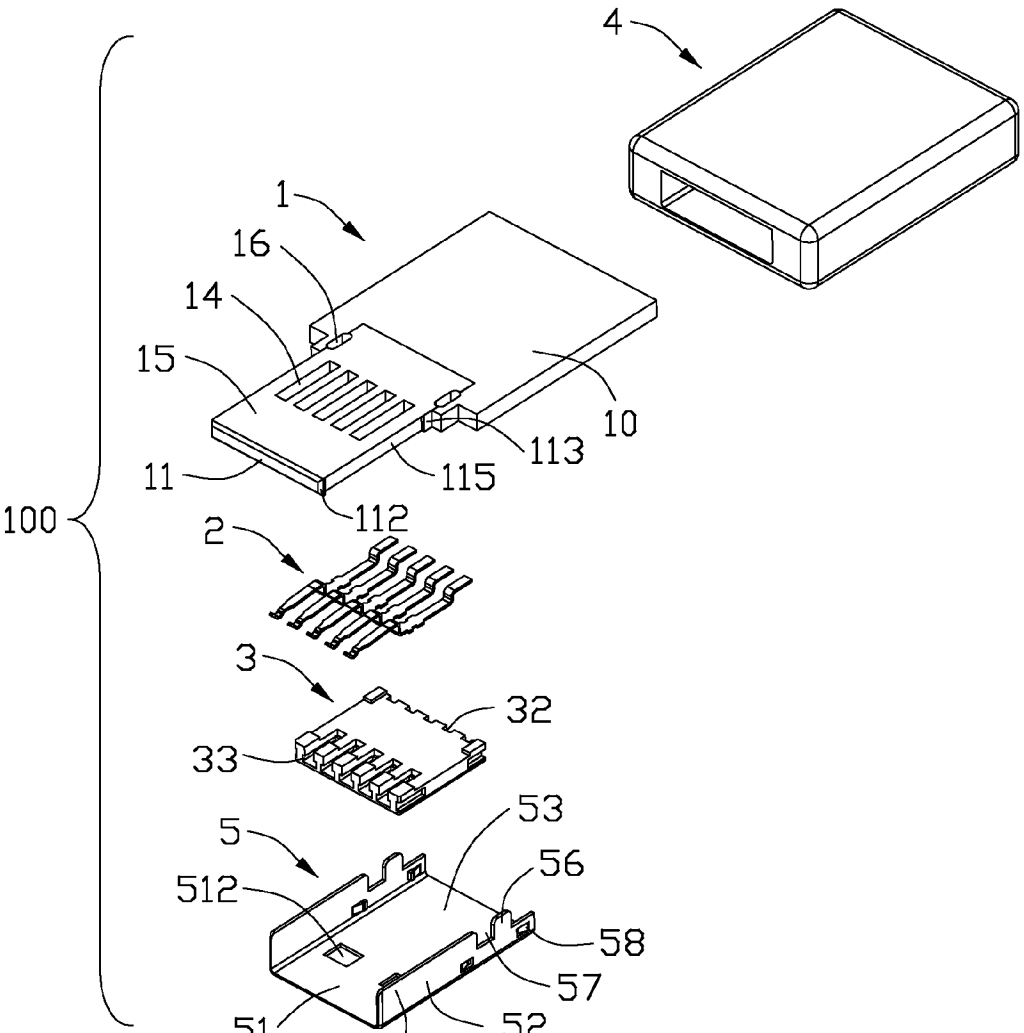
FIG. 5 is similar to FIG. 4, but viewed from another aspect.
Figure 6:
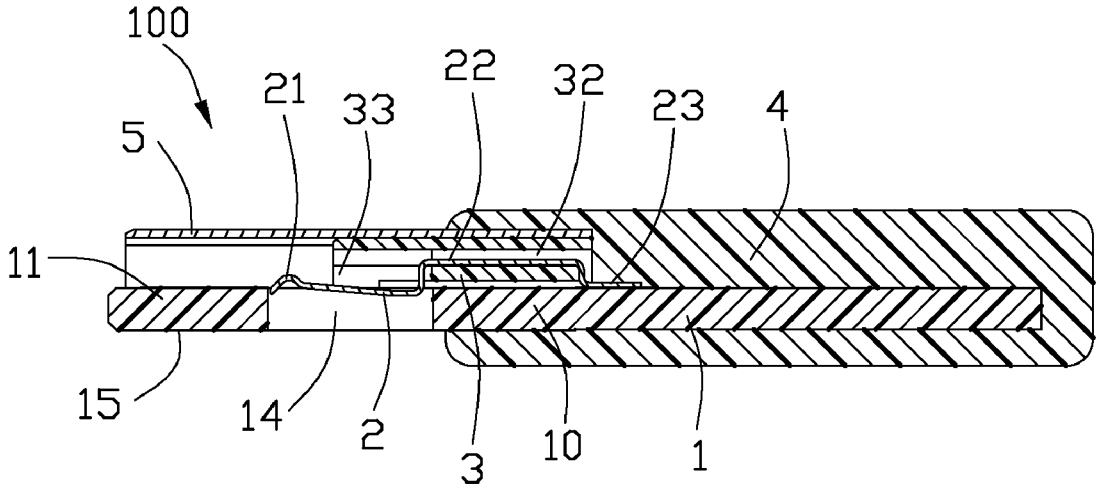
FIG. 6 is a cross-sectional view of the plug connector taken along line 6-6 shown in FIG. 1.

Referring to FIGS. 4 and 5, the PCB 1 includes a base portion 10 and a tongue portion 11 extending forwardly from a front end of the base portion 10. The base portion 10 defines a plurality of metal soldering pads 12 formed on an upper surface thereof and a pair of through holes 16 passing therethrough in a height direction of the plug connector 100. The tongue portion 11 has a plurality of metal contacting pads 13 formed on an upper surface thereof and arranged in a front row along a transverse direction for mating with the receptacle connector, and a plurality of passageways 14 passing therethrough in the height direction and arranged in a back row along the transverse direction. The contacting pads 13 are formed by golden fingers of the PCB 1. The tongue portion 11 has a lower surface opposite to the upper surface and being coated or adhibited with a metal film 15. The metal film 15 extends backwardly beyond the passageways 14 and the through holes 16 from a front end of the lower surface to the base portion 10. The metal film 15 could contact with metal spring tabs of the receptacle connector to eliminate the static electricity of the plug connector and prevent electromagnetic interference. The tongue portion 11 has a notch 115 recessed inwardly from each side face thereof, and forms a front portion 112 at front of the notch 115, a back portion 113 at back of the notch 115, and a bottom portion 114 at bottom of the notch 115.

Referring to FIG. 3-6, each resilient contact 2 has a tail portion 23 for being soldered on the soldering pad 12, a resilient contacting portion 21 being movably received in the passageway 14 for mating with the receptacle connector, and a connecting portion 22 connecting the contacting portion 21 and the tail portion 23. The contacting portion 21 bending downwardly and extending forwardly from a front end of the connecting portion 22. The tail portion 23 bending downwardly and extending backwardly from a rear end of the connecting portion 22. The connecting portions 22 are assembled to a plurality of cavities 32 of the insulator 3, therefore, the resilient contact 2 and the insulator 3 are formed as a contact module together for being assembled to the PCB 1, the tail portions 23 will be soldered on the soldering pads 12 securely, and when the resilient contacting portions 21 are deflected by the receptacle connector, the tail portions 23 will not be deflected and will electrically connect to the soldering pads 12 reliably. Each connecting portion 22 has a set of projections 225 projecting from two lateral sides thereof for interferentially engaging with the corresponding cavity 32.

The insulator 3 has a plurality of grooves 33 communicating with the cavities 32 and collaborating with the passageways 14 together to offer spaces for the contacting portions 21 deflecting in the height direction. Furthermore, the grooves 33 of the insulator could restrict the contacting portions 21 therein so as to prevent the contacting portions 21 from over deflection. The resilient contacts 2 comprise two pairs of differential contacts and a grounding contact located between the two pairs of differential contacts. The metal contacting pads 13 are adapted for USB 2.0 protocol. The metal contacting pads 13 and the resilient contacts 2 are adapted for USB 3.0 protocol. The metal contacting pads 13 and the contacting portions 21 are located on the upper surface of the tongue portion 11 and are arranged in two rows along a front-to-back direction. In other embodiments, the resilient contact 2 could be insert molded into the insulator 3 so as to form as a contact module together for being assembled to the PCB 1. The plug connector 100 using the PCB 1, the metal contacting pads 13 and the resilient contacts 2 to form as a USB 3.0 plug connector will diminish the cost of production and miniaturize the volume of the plug connector 100.

Referring to FIGS. 1-6, the metal shell 5 envelopes the insulator 3 and the upper surface of the tongue portion 11, and collaborates with the upper surface of the PCB together to form a receiving space 101 for receiving a tongue plate of the receptacle connector. The metal shell 5 includes a top wall 51 located above the upper surface of the tongue portion 11, a pair of side walls 52 extending downwardly from two lateral sides of the top wall 51, and an opening 53 downwardly open to an exterior. The top wall 51 has a pair of perforations 512 for being latched by metal spring tabs of the receptacle connector. Each side wall 52 includes a retaining portion 55 extending downwardly and retained in the corresponding notch 115 of the tongue portion 11, a leg 56 extending downwardly and retained in the corresponding through hole 16, and a cutout 57 formed between the retaining portion 55 and the leg 56. A pair of latching tabs 58 project inwardly from each side wall 52 to interferentially engage with the insulator 3. The retaining portion 55 is resisted backwardly, forwardly, and upwardly by the front portion 112, the back portion 113, and the bottom portion 114 respectively. Therefore, the retaining portion 55 will be retained in the notch 115 firmly. The metal shell 5 is assembled downwardly into the PCB along the height direction and dose not has a bottom wall for covering the lower surface of the tongue portion 11, The side walls 52 of the metal shell 5 have side surfaces coplanar with the side faces of the tongue portion 11, therefore, the volume of the plug connector 100 will be miniaturized. In other embodiments, the side walls 52 or other portions of the metal shell 5 could contact with the metal film 15, and the plug connector could be a USB flash disk.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A plug connector for mating with a receptacle connector comprising: a PCB having opposed upper and lower surfaces; a plurality of metal contacting pads disposed on the upper surface of the PCB; a metal shell enveloping the upper surface of the PCB and collaborating with the upper surface to form a receiving space for receiving a tongue plate of the receptacle connector; and a metal film covering the lower surface of the PCB;

wherein the metal film is coated or adhesive onto the lower surface of the PCB;

wherein the metal shell comprises a top wall, a pair of side walls extending downwardly from two lateral sides of the top wall, and an opening downwardly open to an exterior, the lower surface of the PCB is exposed over the opening;

wherein the PCB has a pair of notches recessed inwardly from two side faces thereof, the side walls have retaining portions retained in the corresponding notches, the side walls have side surfaces coplanar with the side faces of the PCB; and wherein the PCB has front portions at front of the notches for resisting the retaining portions backwardly, back portions at back of the notches for resisting the retaining portions forwardly, and bottom portions at bottom of the notches for resisting the retaining portions upwardly.

2. The plug connector according to claim 1, wherein the PCB has a pair of through holes, the side walls have legs extending downwardly and retained in the corresponding through holes.

3. The plug connector according to claim 1, wherein the plug connector comprises a plurality of resilient contacts mounted on the PCB, the resilient contacts comprise contacting portions protruding upwardly beyond the upper surface and located behind the contacting pads, tail portions mounted on the PCB, and connecting portions connecting the contacting portions and the tail portions, the contacting pads and the resilient contacts are adapted for USB 3.0 protocol.

4. The plug connector according to claim 3, wherein the plug connector further comprises an insulator attached to the PCB, the connecting portions are retained on the insulator.

5. The plug connector according to claim 4, wherein the insulator has a plurality of cavities formed thereon, the connecting portions are assembled into the cavities.

6. The plug connector according to claim 4, wherein the PCB has a plurality of passageways passing therethrough, the insulator has a plurality of grooves collaborating with the passageways together to offer spaces for the contacting portions deflecting in a height direction of the plug connector.

7. An USB flash disk comprising:

a PCB defining a base portion and a tongue portion with a plurality of metal contacting pads disposed on an upper surface thereof;

a metal shell enveloping the upper surface of the tongue portion and forming a receiving space between the metal shell and the upper surface, the metal shell defining an opening downwardly open to an exterior for a lower surface of the tongue portion to be exposed over; and a metal film covering the lower surface of the PCB;

wherein the metal film is coated or adhesive onto the lower surface of the tongue portion;

wherein the metal shell is assembled downwardly into the PCB along a height direction of the PCB, the metal shell comprises a top wall, and a pair of side walls extending downwardly from two lateral sides of the top wall and being attached to two lateral sides of the tongue portion;

wherein the tongue portion has a pair of notches recessed inwardly from two side faces thereof, the side walls have retaining portions received in the corresponding notches, the side walls contact with the metal film and have side surfaces coplanar with the side faces of the PCB; and wherein the USB flash disk comprises an insulator attached to the upper surface the PCB and a plurality of resilient contacts mounted on the PCB and retained in the insulator, the resilient contacts comprise contacting portions protruding upwardly into the receiving space, tail portions mounted on the base portion, and connecting portions connecting the contacting portions and the tail portions and being retained in the insulator, the contacting pads and the resilient contacts are adapted for USB 3.0 protocol.

8. The USB flash disk according to claim 7, wherein the tongue portion has a plurality of passageways passing therethrough and located behind the metal contacting pads, the insulator has a plurality of grooves collaborating with the passageways together to offer spaces for the contacting portions deflecting in a height direction of the PCB, the metal film extend backwardly beyond the passageways from a front end of the lower surface.

9. A USB interface plug device for coupling to a complementary receptacle connector, comprising:

a printed circuit board defining opposite first and second surface;

a plurality of contacting pads formed upon the first surface adjacent to a front edge of the printed circuit board;

a plurality of through holes formed in the printed circuit board and extending through said first and second surfaces and behind said contacting pads in a front-to-back direction;

a terminal module including an insulator secured to the printed circuit board and located behind the through holes, a plurality of contacts retained to the insulator under condition that resilient contacting sections of said contacts are essentially aligned with the corresponding through holes in a vertical direction perpendicular to said front-to-back direction; and a metallic shell covering a front portion of the printed circuit board and cooperating with said front portion to receiving a mating tongue of the complementary receptacle connector; wherein contacting points of the contacting sections are exposed upon the first surface so as to be in and out moveable with regard to the corresponding through holes, respectively during mechanically and electrically mating with corresponding stiff terminals of the complementary receptacle connector under condition that the contacting pads mechanically and electrically connect corresponding resilient terminals of the complementary receptacle connector simultaneously;

wherein the metallic shell covers to side edges of front portion of the printed circuit board while exposing the second surface to an exterior;

wherein a metal film is coated or adhesive onto the second surface; and wherein said insulator is fully positioned upon the first surface.

* * * * *